United States Patent [19]

Engdahl, Jr.

[11] 4,210,248

[45] Jul. 1, 1980

[54] PACKAGING FOR RETORTABLE POUCH

[76] Inventor: Arnold B. Engdahl, Jr., 15282 Moulins Cir., Irvine, Calif. 92714

[21] Appl. No.: 968,494

[22] Filed: Dec. 11, 1978

[51] Int. Cl.[2] ..... B65D 85/54

[52] U.S. Cl. ..... 206/525; 229/2.5 R; 229/87 F; 220/405; 426/127; 206/484; 206/594

[58] Field of Search ..... 206/525, 275, 484, 484.2, 206/594; 229/2.5, 44 R, 87 F; 220/461, 405; 99/646 C; 426/127

[56] References Cited

U.S. PATENT DOCUMENTS

| | | | |
|---|---|---|---|
| 1,866,408 | 7/1932 | Hart | 229/2.5 |
| 2,089,728 | 8/1937 | Bogden | 229/2.5 |
| 2,217,455 | 10/1946 | Price | 229/2.5 |
| 3,099,377 | 7/1963 | Metzeler | 229/2.5 |
| 3,487,915 | 1/1970 | Scott | 206/525 |
| 3,511,433 | 5/1970 | Andrews | 229/44 R |
| 3,938,730 | 2/1976 | Detzel | 206/525 |

*Primary Examiner*—Herbert F. Ross

*Attorney, Agent, or Firm*—Jackson, Jones & Price

[57] ABSTRACT

A compound food package having a sealed, heat resistant pouch and a container therefor, is disclosed. The pouch, which contains uniformly distributed food items, has a substantially flat circumferential seam. The container is composed of semi-rigid plastic material. It contains a cavity into which the pouch is placed. The container has substantially flat rim portions. The rim portions engage the seam of the pouch and position and hold the pouch by its seam. The pouch is in intimate contact with the inner surfaces of the container, thereby counteracting inwardly directed forces and significantly contributing to the overall strength of the package.

13 Claims, 4 Drawing Figures

PACKAGING FOR RETORTABLE POUCH

BACKGROUND OF THE INVENTION

1. Field of the Invention

The present invention relates to a compact food package and more particularly to a compact food package having a retortable, food-containing pouch and a container for the pouch.

2. Description of the Prior Art

The prior art is well aware of sealed packages adapted for storing perishable food for an indeterminate duration. According to well-established practice, appropriately sterilized, perishable food is often stored for a long duration in pouches, bags or like enclosures which are hermetically sealed so as to prevent the entry of micro-organisms into the package. Such pouches, bags or like enclosures typically comprise suitable plastic sheet material. An airtight seal is readily provided by heat sealing adjoining edges of the plastic material.

In many packaging applications, it is not necessary or desired to preserve food without refrigeration for a long duration. Therefore, the packaging container is designed to provide only limited protection from exposure to the environment of the food items contained in the package.

In both types of packaging applications mentioned above, however, it is often necessary to provide structural strength to the food package in addition to any structural strength provided by the sealable plastic enclosure. Therefore, it has become widespread practice to utilize a semi-rigid plastic, cardboard or like shell for at least partially containing the food. The plastic or cardboard shell is then closed by a stretchable, thin plastic or like sheet. U.S. Pat. Nos. 3,695,900; 3,916,030; 3,619,215; 3,922,362; 2,776,215; 2,776,216 and 2,261,129 disclose such food packages having a relatively stiff base and a preferably transparent, thin plastic sheet enclosing the base and the food items contained therein.

Additional disclosures relevant to food packaging in general can be found in U.S. Pat. Nos. 3,865,302; 4,055,672 and 2,135,479.

A significant disadvantage of the food packages provided by the prior art is that the sealed bag or pouch which contains the food, is relatively readily punctured or otherwise damaged during transportation or storage. Accidental damage to the bag or pouch becomes especially undesirable when the package is intended for preserving the food without refrigeration for an indeterminate duration. It is readily understood that in such a case, accidental damage to the bag or pouch may result in total destruction of the food item contained therein.

Accordingly, the prior art does not provide a compact, lightweight food package having the features of the herein-disclosed package which provides improved protection for food of all kinds, including soft or liquid food items, such as preserves or jellies.

SUMMARY OF THE INVENTION

It is an object of the present invention to provide an inexpensive, lightweight compound package for food products.

It is another object of the present invention to provide a lightweight protective shell for a food containing pouch which occupies a minimum amount of space and is therefore particularly suited for use by hikers, outdoorsmen and the like.

It is still another object of the present invention to provide an inexpensive and lightweight shell for a food containing pouch which provides maximum protection against accidental damage to the pouch during shipping or shelf display.

These and other objects and advantages are attained by a compound package having a hermetically sealed pouch and a container for the pouch. The pouch, which contains food preserved for a long duration, has a substantially flat circumferential seam. The container has two members which define a cavity to accommodate the pouch. The pouch substantially completely fills the cavity whereby structural support is lent by the pouch to the container. A circumferential rim is provided on each member of the container which in the assembled package engages the seam of the pouch and effectively positions and holds the pouch between the members from its seams.

The objects and features of the present invention are set forth with particularly in the appended claims. The present invention may be best understood by reference to the following description, taken in connection with the accompanying drawings in which like numerals indicate like parts.

DESCRIPTION OF THE PREFERRED EMBODIMENT

Figure 1:
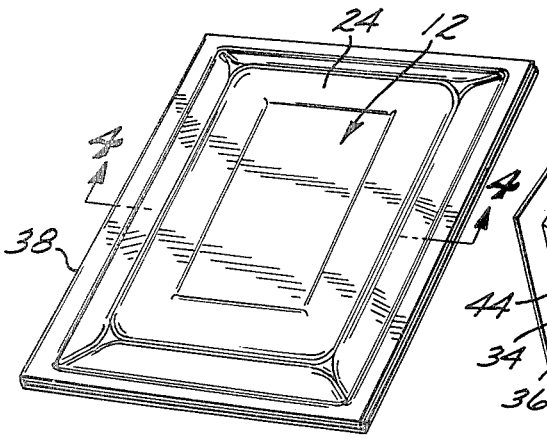
FIG. 1 is a perspective view of a preferred embodiment of the present invention.
Figure 2:
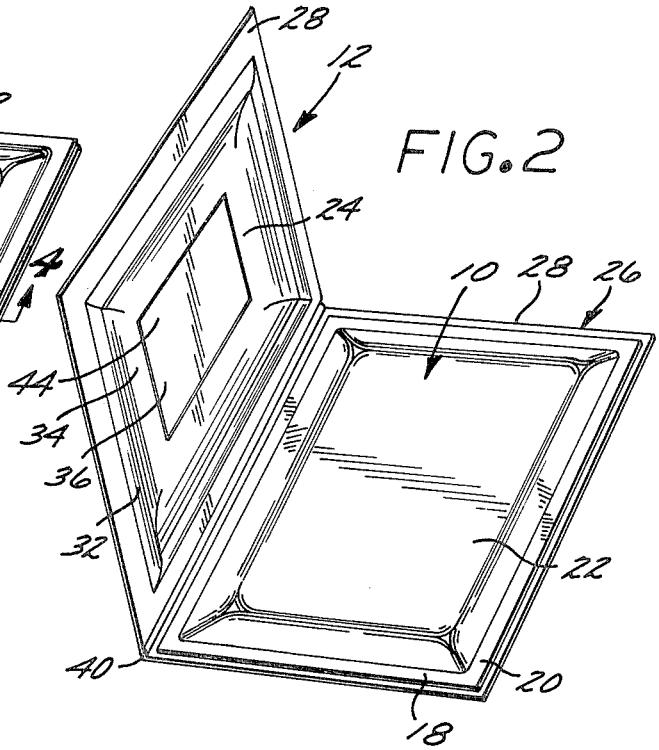
FIG. 2 is a perspective view of the preferred embodiment of the present invention with a container for the pouch being disposed in an open position.

The following specification taken in conjunction with the drawings sets forth the preferred embodiment of the present invention in such a manner that any person skilled in the food-packaging and plastic manufacturing arts can use the invention. The embodiment of the invention disclosed herein is the best mode contemplated by the inventor for carrying out his invention in a commercial environment, although it should be understood that various modifications can be accomplished within the parameters of the present invention.

Referring now to FIGS. 1 through 4, a preferred embodiment of a food-containing pouch 10 and a protective container 12 thereof are disclosed. The food-containing pouch 10, best shown individually in FIG. 3, and in the cross-sectional view of FIG. 4, comprises two relatively thin substantially rectangular sheets 14. The sheets 14 may be composed of suitable, heat-sealable, transparent plastic material. Such materials are used widely in the food packaging arts. In the preferred embodiment, however, the sheets 14 comprise a layer (not shown) of aluminum foil which on the inside surface thereof is coated with the suitable plastic material.

In the process of packaging of a food item 16, such as a fruit preserve, jelly or the like, the appropriately sterilized food item 16 is placed between the sheets 14. The sheets 16 are then sealed along their entire circumferential edge 18 by a suitable method such as heat sealing of the plastic laminate which comprises the inside layer of the sheets 18. The sealing process is conducted in such a manner that food is excluded from the sealed portions.

It is to be noted that materials and methods of enclosing food in heat-sealed plastic plackages or pouches are well known in the prior art. Therefore, details of manufacturing the sealed pouch 10 used in the present invention need not be disclosed here. It is sufficient to disclose in detail only those features of the pouch 10 which render it uniquely adapted for use in the present invention.

By appropriately selecting a suitable material for the pouch 10, the pouch may be significantly heat resistant. As a result, it is possible to package food items in the pouch 10 which require cooking or heating prior to consumption. Thus, by providing a heatable or retortable pouch in which the food can be stored as well as heated, a user is saved the convenience of having the open the pouch and transfer its contents into other cooking vessels.

Figure 3:
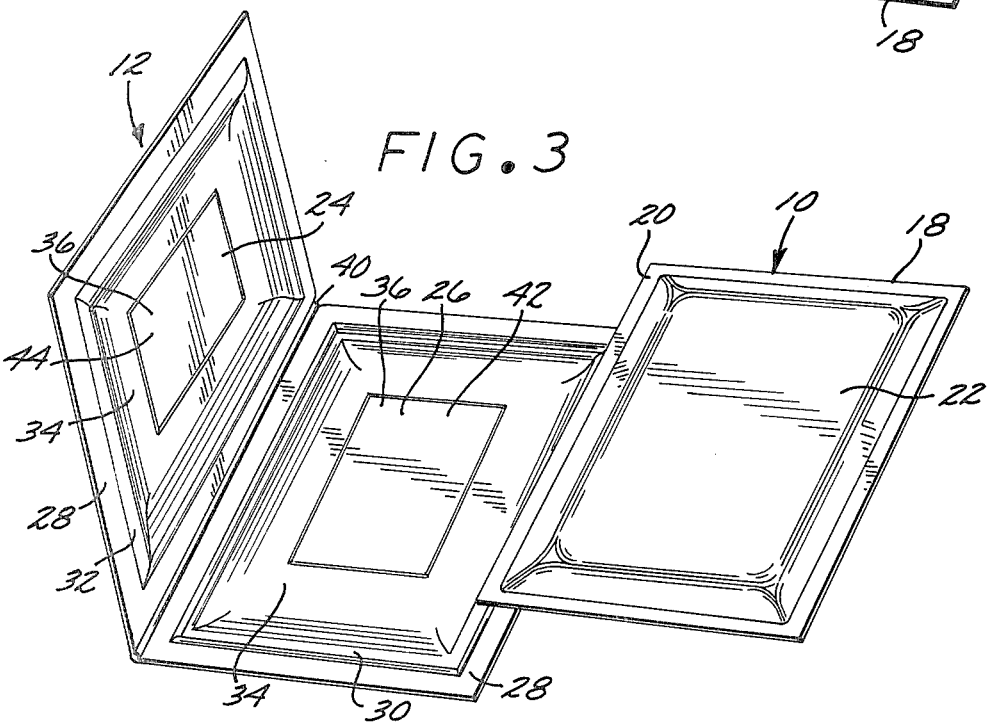
FIG. 3 is a perspective, partially exploded view of the preferred embodiment of the present invention with the container for the pouch being disposed in an open position.
Figure 4:
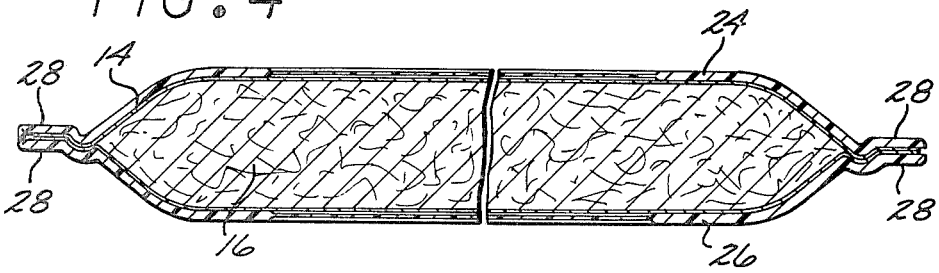
FIG. 4 is a cross-sectional view of the preferred embodiment of the present invention, the cross-sections being taken at lines 4—4 of FIG. 1.

As it is shown in FIGS. 3, 4 and 5, the sealing process results in a substantially flat seam 20. The pouch 10 itself, when filled with the food item 16, is substantially flat, with a food containing portion 22 having a significantly wider cross-section (best shown in FIG. 4), then the seam portion 20.

Referring now particularly to the exploded view of FIG. 3, the container 12 for the pouch 10 is disclosed. The container 12 comprises two panel members 24 and 26, which in the preferred embodiment have many similar features. The panel members 24 and 26 are substantially rectangular in shape and have a substantially flat rim or edge portion 28. As this will be explained below in more detail, the rim or edge portions 28 serve the purpose of engaging the seam 20 of the pouch 10.

A protruding portion 30 is disposed immediately adjacent to the rim portion 28 in one of the panel members 26. In the other panel member 24, an indentation or offset portion 32 is present to accommodate the protruding portion 30 when the two panel members 24 and 26 occupy a closed, substantially parallel, aligned position, shown in FIG. 1.

In both panel members 24 and 26, an inwardly sloping intermediate portion 34 is contiguous respectively to the protruding portion 30 or indentation 32. A substantially flat, rectangular portion 36 abuts the intermediate portion 34 in both panel members 24 and 26.

The two panel members 24 and 26 are pivotally joined to one another on a longer side 38 of each panel member by a thin, relatively flexible portion 40. Such a flexible plastic portion is commonly referred to as a living hinge in the plastic manufacturing arts. Briefly, a living hinge is a thin section of plastic which due to its particular mode of manufacture has a minimal amount of "plastic memory" or "set" relative to its designated direction or rotation or flexing. Therefore, the living hinge is capable of undergoing a relatively large number of bending or flexing motions without any attendant structural damage.

As it is apparent from the above description the entire container 12 including the living hinge 40 is advantageously of a unitary construction. The container 12 is readily manufactured from styroform or similar plastic foam material. The process of manufacturing articles of various shapes and sizes from styrofoam or like material, including the manufacture of the living hinge, is well established in the prior art and therefore, need not be disclosed here in detail.

The entire container 12 is dimensioned and configured to accommodate the pouch 10. Thus, the container 12 in a closed position, wherein the panel members 24 and 26 are disposed substantially parallel relative to one another, incorporates a cavity. The pouch 10 is placed within the cavity wherein it substantially fills the void. The panel members 24 and 26 engage with their respective inner surfaces 42 and 44 substantially the whole outer surface of the food containing portion 30 of the pouch 10. As a result, the pouch 10 with its food contents 16 significantly contributes to the structural strength of the entire package. The pouch 10 contributes to the container's 12 ability to withstand an impact without splitting, breaking or suffering like damage. On the other hand, the container 12 protects the pouch 10 from being punctured or ruptured by a sharp object. It is readily apparent that the container 10 renders the handling, transportation and storage of the pouch 10 significantly easier and safer.

Referring now again to FIGS. 2, 3 and 4, the seam 20 of the pouch engaging the rim or edge portions 28 of the panel members 24 and 26, is shown. As the seam 20 is engaged on both of its sides by the rim 28 of one of the panel members, the pouch 10 is securely held in place in position between the panel members 24 and 26. Additionally, any well known closure means such as a rubberband or a string (not shown) may be utilized to prevent the container 12 from opening.

The novel, compound food package of the present invention is ideally suited for storing any type of food solid in semi-solid or liquid food items such as preserves, jellies, purees or the like. The scope of the present invention is intended to cover such applications. It should also be understood that although the hereinbefore disclosed configuration for the container and the pouch 10 is preferred, the present invention may be practiced by modifying the same within the generic principles taught here. For example, the pouch 10 and the container 12 may have other than a rectangular shape, and the two panel members 24 and 26 may be joined by means other than a living hinge. Accordingly, such apparent modifications are within the scope of the present invention.

The light weight, overall flat shape and its ability to serve as a storage as well as a cooking container renders the compound food package of the present invention particularly suitable for use by hikers, backpackers, outdoorsmen and the like. It will be readily apparent to those skilled in the art that various modifications of the present invention are possible within the generic principles disclosed herein. Accordingly, the scope of the present invention should be interpreted solely from the following claims.

What is claimed is:

1. A compound package for food products comprising:

a sealed enclosure of substantially flat overall appearance having a portion wherein the food products are contained and a peripheral edge which is substantially narrower in cross section than the food products containing portion, and a container for accommodating the enclosure and configured to define a cavity of substantially the same size as said food containing portion and to be in contact with a substantial portion of the outer surface of the enclosure, and for fully surrounding at least the food products containing portion of the enclosure, the container having at least two substantially flat portions dimensioned to be superimposed in close proximity relative to one another, the flat portions being configured to accommodate between one another and to be in contact with the peripheral edge of the enclosure whereby the enclosure is held in position within the container and whereby the enclosure lends structural support to the container against a crushing force, and the like and whereby the container protects the enclosure from being damaged by a sharp object and the like.

2. The invention of claim 1 wherein the container further comprises an upper and a lower member each having at least one of the substantially flat portions.

3. The invention of claim 2 wherein the lower and upper members each have the substantially flat portion at their respective peripheral edge.

4. The invention of claim 3 wherein the lower and upper members each further comprise a substantially flat center portion and an intermediate portion, the intermediate portion sloping from the peripheral edge towards the center portion.

5. The invention of claim 4 wherein the upper and lower members are permanently and pivotally mounted to one another by a thin portion comprising a living hinge.

6. A food package assembly comprising:

a pouch containing food for storage for an indeterminate time, the pouch having a food containing portion and a substantially flat peripheral edge which comprises a sealed seam; and a container for the pouch, the container comprising two members pivotally mounted relative to one another, the two members being configured to define a cavity of substantially the same size of said food containing portion and wherein the pouch is accommodated, each member having an inside surface which is superimposed to and in contact with at least a substantial portion of a major surface of the pouch whereby the container entirely surrounds at least the food containing portion of the pouch and the pouch lends structural support to the container, each member having a peripheral edge which in a closed posture of the container engages the seam of the pouch whereby the pouch is held in position within the container.

7. The invention of claim 6 wherein the sealed seam is disposed around the entire periphery of the pouch and wherein the entire seam is engaged by the two members of the container.

8. The invention of claim 6 wherein the container is of a plastic foam material and wherein the two members are mounted to one another by a narrow portion comprising a living hinge.

9. The invention of claim 8 wherein the container is substantially rectangular in shape.

10. In a food package assembly having a substantially flat heat resistant pouch containing food for storage for an indeterminate duration, the pouch having a sealed seam surrounding the entire periphery of the pouch, the improvement comprising:

a container of unitary construction for the pouch, the container having two panel members pivotally mounted relative to one another and capable of occupying a closed position wherein the container is substantially flat, the two panel members when closed are configurated to define a cavity of substantially the same size as said food containing portion and to be in contact with a substantial majority of the outer surface of the pouch whereby the cavity accommodates the pouch, each panel member having rim portions dimensioned to engage and hold the same of the pouch in the closed position of the container thereby holding the pouch in position within the container, the assembled pouch and container comprising the food package assembly wherein the pouch lends structural strength to the container and the container protects the pouch against rupture and like damage.

11. The improvement of claim 10 wherein the two panel members are mounted to one another by a thin plastic portion joining an edge of each panel member, the thin plastic portion being adapted for repeated bending motion.

12. The improvement of claim 11 wherein the container is substantially rectangular in shape.

13. The improvement of claim 10 wherein the pouch comprises a first and a second sheet of laminated material said first and second sheets being attached to one another at the sealed seam, and wherein the entire food package assembly has a substantially rectangular and flat configuration.

* * * * *